US009732509B2

(12) United States Patent
Zarraonandia

(10) Patent No.: US 9,732,509 B2
(45) Date of Patent: Aug. 15, 2017

(54) UNDERGROUND SYSTEM ADAPTED FOR RETAINING OR DETAINING STORMWATER

(71) Applicant: Pre-Con Products, Simi Valley, CA (US)

(72) Inventor: David Zarraonandia, Thousand Oaks, CA (US)

(73) Assignee: PRE-CON PRODUCTS, Simi Valley, CA (US)

( * ) Notice: Subject to any disclaimer, the term of this patent is extended or adjusted under 35 U.S.C. 154(b) by 56 days.

(21) Appl. No.: 14/710,230

(22) Filed: May 12, 2015

(65) Prior Publication Data

US 2016/0333563 A1 Nov. 17, 2016

(51) Int. Cl.
*E02B 11/00* (2006.01)
*E03F 1/00* (2006.01)

(52) U.S. Cl.
CPC ..... *E03F 1/005* (2013.01)

(58) Field of Classification Search
CPC ..... E03F 1/005; E02B 11/00
See application file for complete search history.

(56) References Cited

U.S. PATENT DOCUMENTS 3,799,383 A 3/1974 Gerhard
6,648,549 B1 * 11/2003 Urriola ..... E03F 1/005 210/170.03
6,991,402 B2 1/2006 Burkhart
7,160,058 B2 1/2007 Burkhart
7,344,335 B2 3/2008 Burkhart
7,704,011 B2 * 4/2010 Marshall ..... E01C 3/006 404/29
D617,867 S 6/2010 May
7,762,205 B1 7/2010 Veazey
7,798,747 B1 9/2010 de Bruijn et al.
8,360,100 B2 * 1/2013 Burkhart, Sr. ..... E03F 5/101 137/265
8,590,564 B2 11/2013 Burkhart, Sr. et al.
8,770,890 B2 7/2014 May et al.
8,985,897 B2 3/2015 Boulton et al.
2005/0100401 A1 5/2005 Urriola et al.
2007/0227094 A1 10/2007 Oscar
2012/0201603 A1 8/2012 Boulton et al.
2014/0105684 A1 * 4/2014 Allard ..... E03F 1/005 405/52

FOREIGN PATENT DOCUMENTS

DE 4400183 A1 * 7/1995 ..... E02B 11/00

* cited by examiner

*Primary Examiner* — John Kreck
(74) *Attorney, Agent, or Firm* — Thompson Coburn LLP; Alan Norman

(57) ABSTRACT

A stormwater management system adapted for retaining or detaining stormwater. The underground system comprises a plurality of cells arranged in a generally honeycomb configuration. Each of the plurality of cells is generally hexagonal in cross-section and has an internal region. The plurality of cells are in fluid communication with one another to allow stormwater to flow from the internal region of one of the plurality of cells to the internal region of another of the plurality of cells.

11 Claims, 11 Drawing Sheets

UNDERGROUND SYSTEM ADAPTED FOR RETAINING OR DETAINING STORMWATER

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable

BACKGROUND OF THE INVENTION

Field of the Invention

The present invention pertains to an underground system adapted for retaining or detaining stormwater.

SUMMARY OF THE INVENTION

One aspect of the present invention is a stormwater management system adapted for retaining or detaining stormwater comprising a plurality of cells arranged in a generally honeycomb configuration. Each of the plurality of cells is generally hexagonal in cross-section and has an internal region. The plurality of cells is in fluid communication with one another to allow stormwater to flow from the internal region of one of the plurality of cells to the internal region of another of the plurality of cells.

Another aspect of the present invention is a cell for a stormwater management system adapted for retaining or detaining stormwater comprising a body portion and an internal region. The body portion is generally hexagonal in cross-section. The body portion comprises six sides and a window in one of the sides. The window is adapted to permit passage of stormwater into and out of the internal region.

Another aspect of the present invention is a method of forming a stormwater management system adapted for retaining or detaining stormwater comprising arranging a plurality of cells in a generally honeycomb configuration. Each of the plurality of cells is generally hexagonal in cross-section and has an internal region. The plurality of cells is arranged in a manner such that stormwater is able flow from the internal region of one of the plurality of cells to the internal region of another of the plurality of cells.

Figure 1:
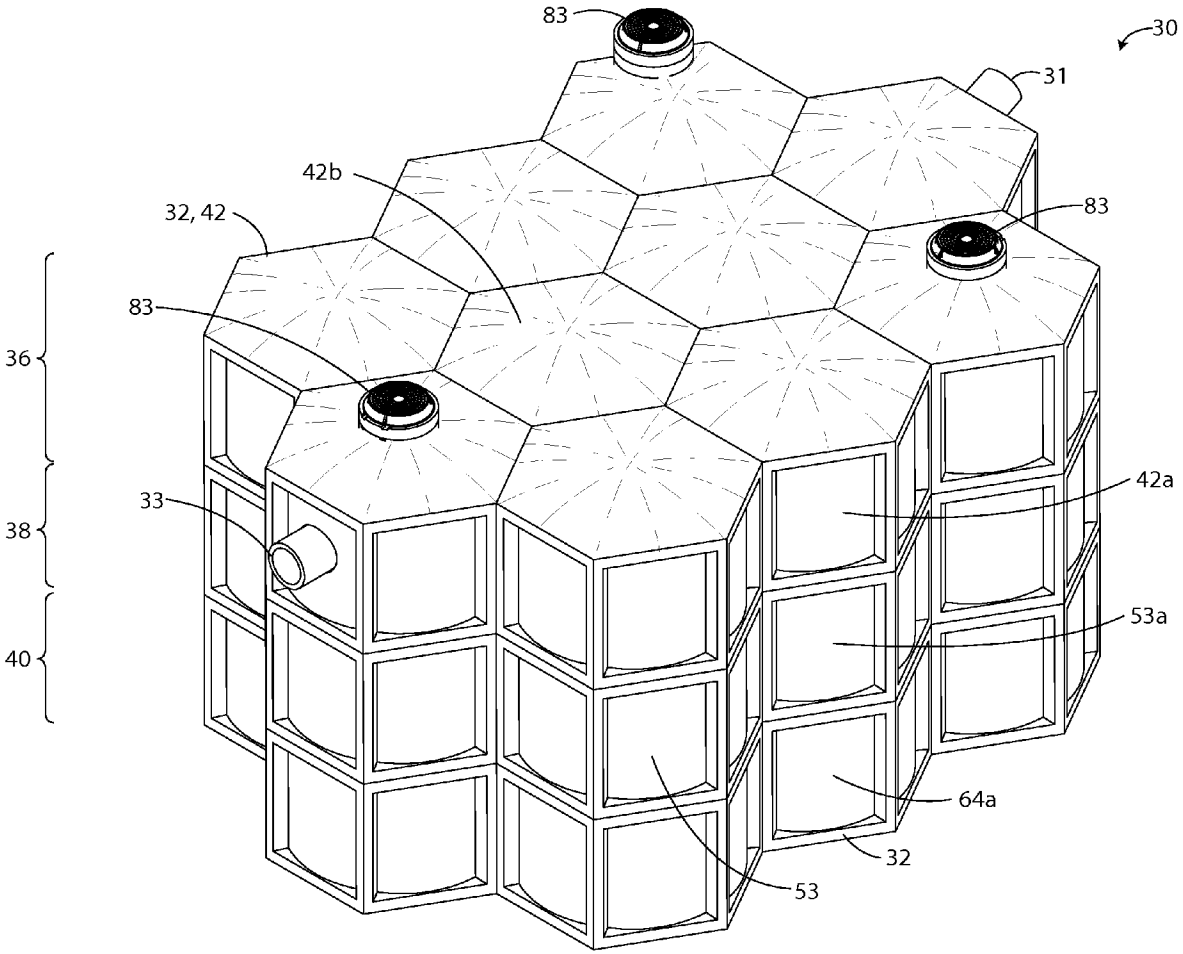
FIG. 1 is a perspective view of an embodiment of a stormwater management system of the present invention, the stormwater management system having a lower level of cells, an upper level of cells, and an intermediate level of cells.

Reference numerals in the written specification and in the drawing figures indicate corresponding items.

DETAILED DESCRIPTION OF THE PREFERRED EMBODIMENTS OF THE INVENTION

An embodiment of a stormwater management system of the present invention is shown in FIGS. 1-4 and indicated generally by reference numeral 30. The stormwater management system 30 is adapted for retaining or detaining stormwater. The stormwater management system 30 comprises an inlet 31 and an outlet 33. The inlet 31 is adapted to enable stormwater to enter the stormwater management system 30 and the outlet 33 is adapted to enable stormwater to be removed from the stormwater management system. One of ordinary skill in the art will understand that the location of the inlet and the location of the outlet could be different. Moreover, one of ordinary skill in the art will understand that the stormwater management system could comprise additional inlets and/or outlets.

Figure 3:
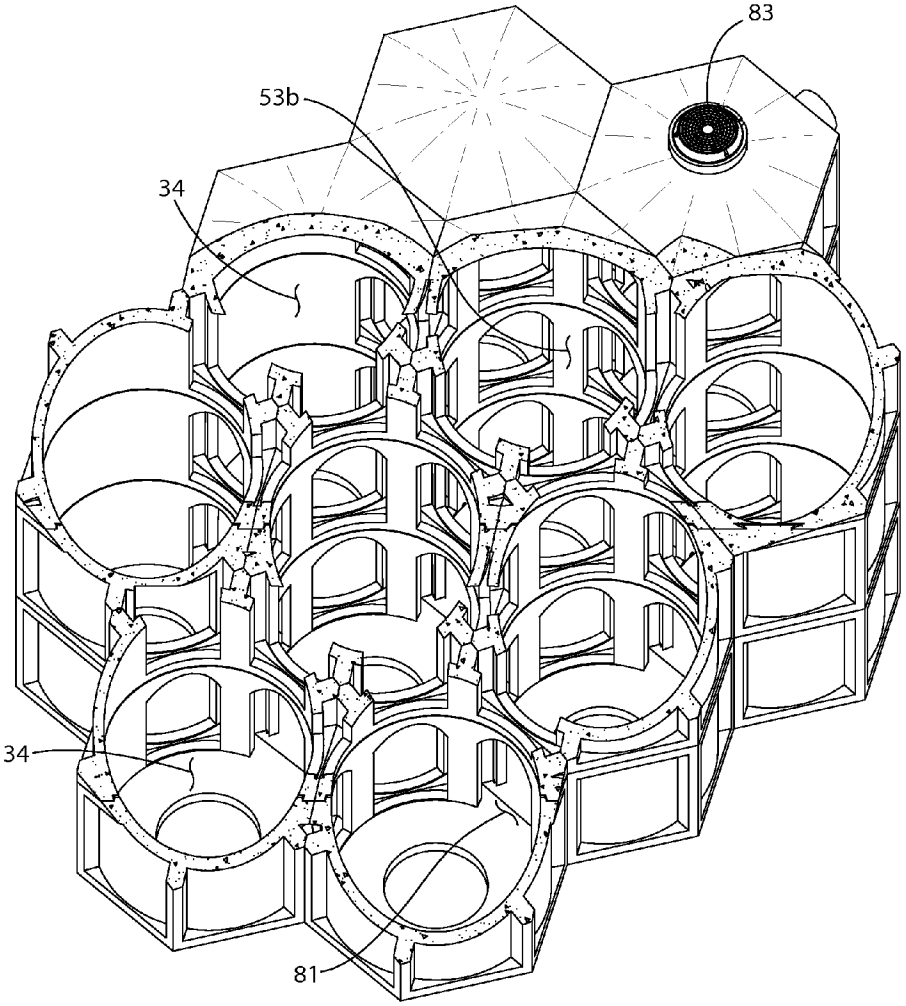
FIG. 3 is a perspective view of the stormwater management system of FIG. 1 with portions broken away to show detail.
Figure 4:
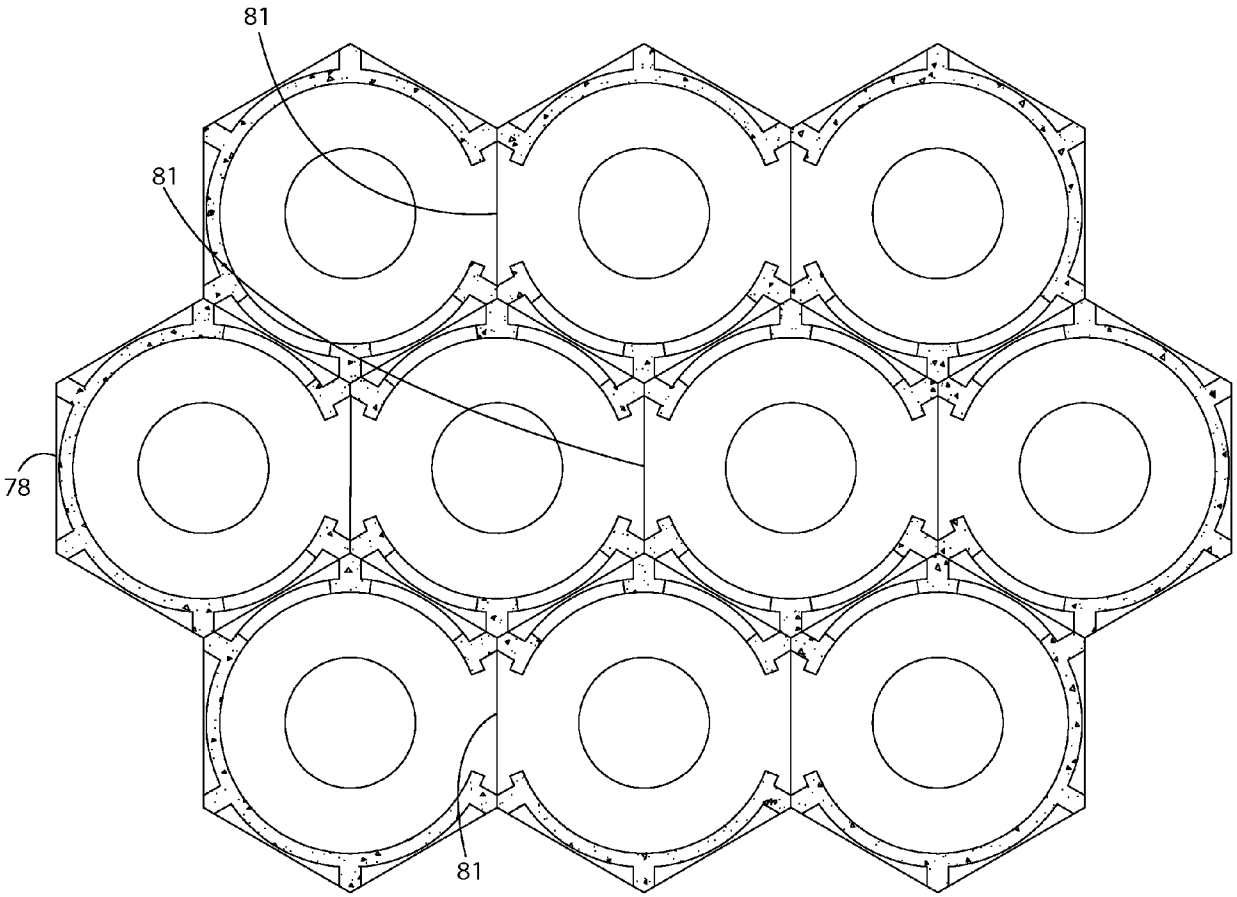
FIG. 4 is a cross-sectional view taken along the plane of line 4-4 of FIG. 2.

The stormwater management system 30 comprises a plurality of cells 32. Each cell 32 is made from a material suitable for use within a stormwater management system, including, but not limited to, concrete. The plurality of cells 32 are arranged in a generally honeycomb configuration. As can be seen in FIGS. 3 and 4, each of the plurality of cells 32 is generally hexagonal in cross-section and has an internal region 34. Moreover, each cell within the stormwater management system 30 is a module (i.e., of a unitary, one piece construction). It is to be understood, however, that the stormwater management system 30 could be constructed such that each cell (or alternatively, each of some of the cells) is made of separate pieces that collectively fit together to form a cell. The plurality of cells 32 are in fluid communication with one another to allow stormwater to flow from the internal region of one of the plurality of cells to the internal region of another of the plurality of cells.

Figure 2:
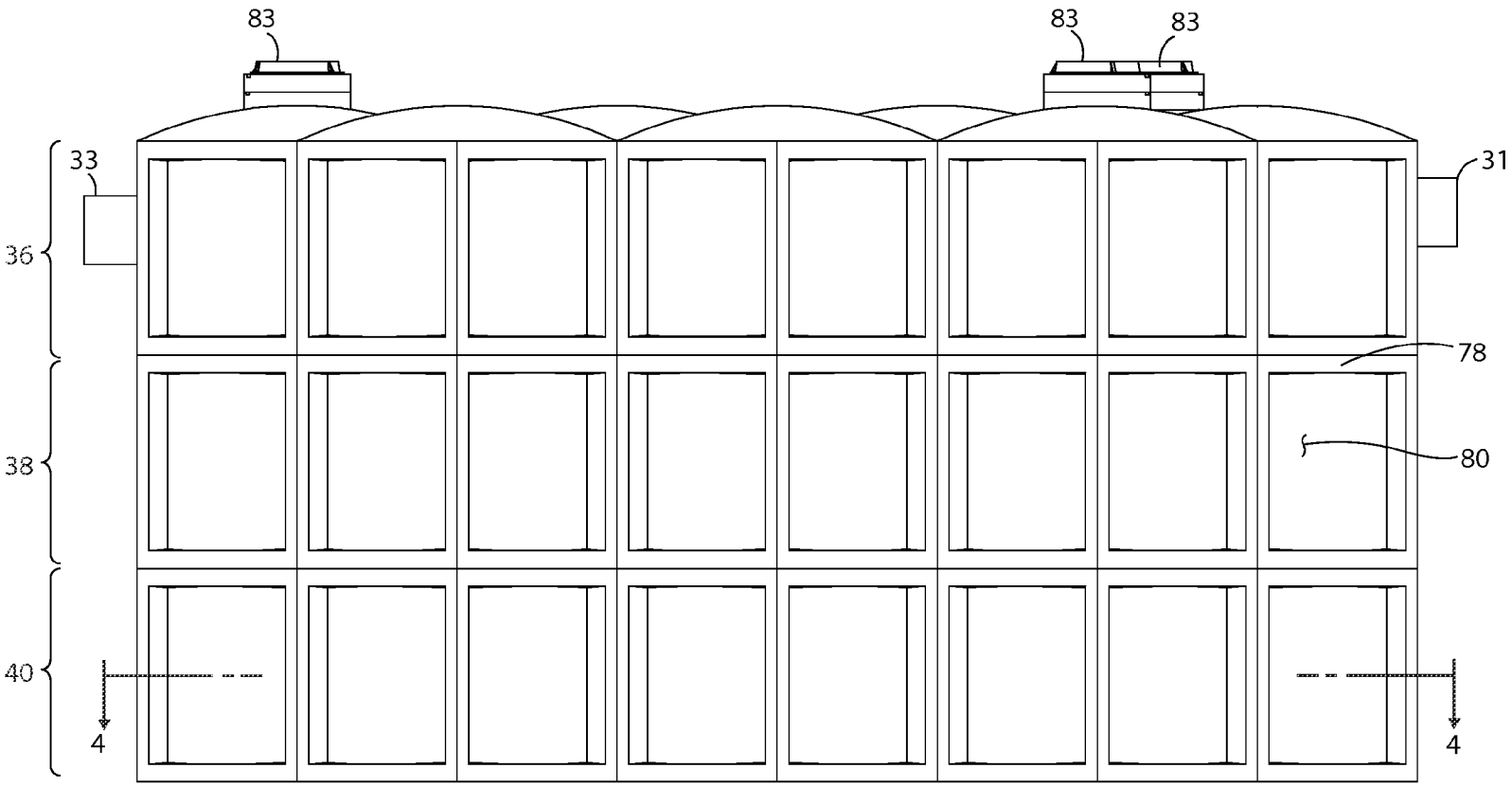
FIG. 2 is a side elevational view of the stormwater management system of FIG. 1.

As shown in FIGS. 1 and 2, the plurality of cells 32 comprises an upper level of cells 36, an intermediate level of cells 38, and a lower level of cells 40. The upper level of cells 36 is over the intermediate level of cells 38. Additionally, the upper level of cells 36 is in fluid communication with the intermediate level of cells 38. The intermediate level of cells 38 is over the lower level of cells 40. Additionally, the intermediate level of cells 38 is in fluid communication with the lower level of cells 40. Accordingly, the upper level of cells 36 is in fluid communication with the lower level of cells 40 via the intermediate level of cells 38.

Figure 5:
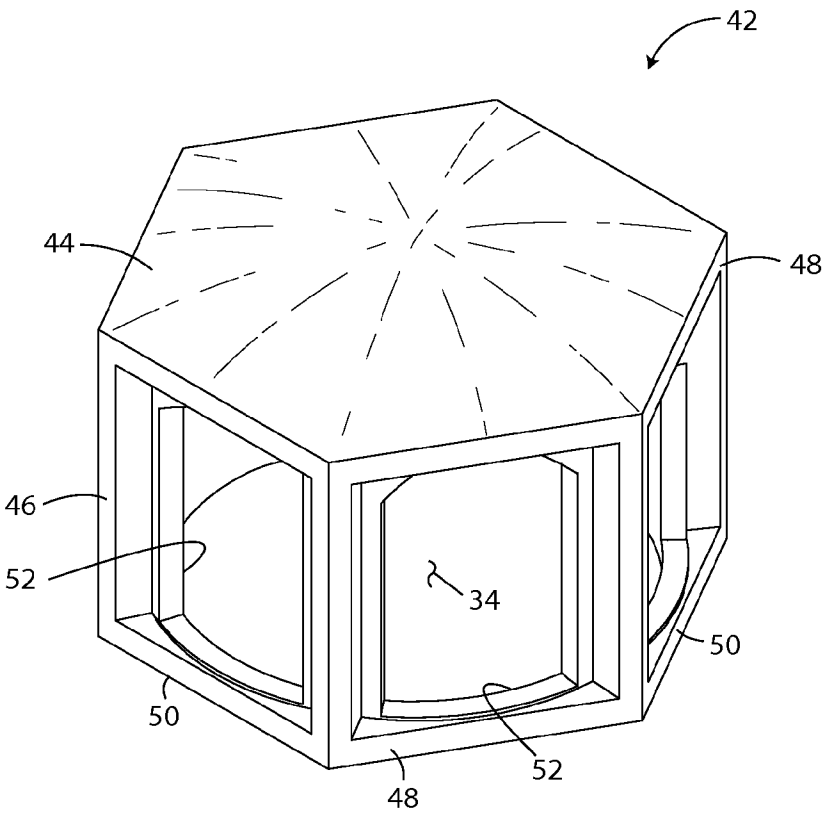
FIG. 5 is a perspective view of one of the cells of the upper level of cells of the stormwater management system of FIG. 1.

An exemplary cell 42 located within the upper level of cells 36 is shown in FIG. 5. Cell 42 comprises a top portion 44 and a body portion 46. The top portion 44 and the body portion 46 bound the internal region 34 of cell 42. The body portion 46 includes an interior surface. The interior surface is of a shape that is generally a right circular cylinder. The interior surface at least in part defines the internal region 34. The top portion 44 and the body portion 46 are generally hexagonal in cross-section. Although the cell 42 of the present embodiment is a module of a molded, one-piece construction, it is to be understood that the top portion 44 and the body portion 46 could be separate pieces that fit together to collectively form cell 42. The top portion 44 of cell 42 is domed such that an inner surface (not shown) of the top portion is concave. It is to be understood that the top portion 44 of cell 42 could alternatively be substantially flat. The body portion 46 comprises six sides 48 and a bottom edge 50. The body portion 46 is generally in the shape of a hexagonal cylinder. More specifically, the body portion 46 is generally in the shape of an equilateral hexagonal cylinder. The body portion 46 also comprises a plurality of windows 52. Each window 52 is in a different one of the six sides 48 and is spaced from the top portion 44 and the bottom edge 50. Additionally, each window 52 is adapted to permit the passage of stormwater into and out of the internal region 34 of cell 42. Although FIG. 5 shows that each window 52 is of the same arched dimension, it is to be understood that the windows could be of different dimensions. Preferably, each window is dimensioned such that an area of each window is at least 50% of an area of the side of the cell in which each window is located. More preferably, each window is dimensioned such that an area of each window is at least 60% of an area of the side in which each window is located. It is also to be understood that a cell could have more or fewer windows than that of cell 42. For example, cell 42*a* has four windows and cell 42*b* has six windows (see FIG. 1).

Figure 6:
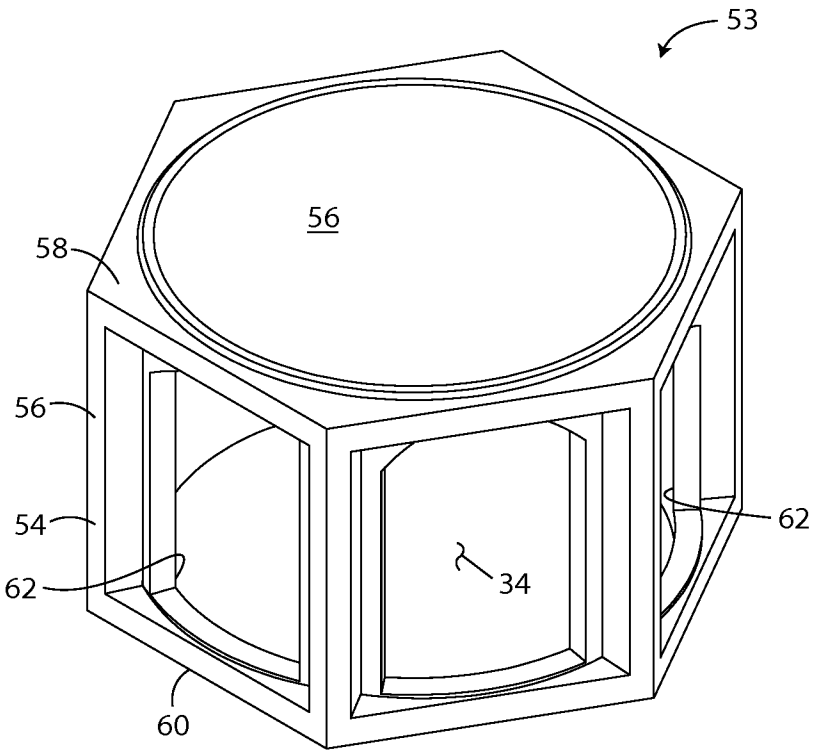
FIG. 6 is a perspective view of one of the cells of the intermediate level of cells of the stormwater management system of FIG. 1.

An exemplary cell 53 located within the intermediate level of cells 38 is shown in FIG. 6. Cell 53 comprises a body portion 54 having six sides 56, a top edge 58, and a bottom edge 60. The body portion 54 bounds the internal region 34 of cell 53. The body portion 54 includes an interior surface. The interior surface is of a shape that is generally a right circular cylinder. The interior surface at least in part defines the internal region 34. More specifically, the body portion 54 is generally in the shape of an equilateral hexagonal cylinder. Moreover, the body portion 54 comprises a plurality of windows 62. Each window 62 is in a different one of the six sides 56 and is spaced from the top and bottom edges 58, 60 of the body portion 54. Additionally, each window 62 is adapted to permit the passage of stormwater into and out of the internal region 34 of cell 53. Although FIG. 6 shows that each window 62 is of the same arched dimension, it is to be understood that the windows could be of different dimensions. It is also to be understood that a cell could have more or fewer windows that that of cell 53. For example, cell 53*a* in FIG. 1 has four windows and cell 53*b* in FIG. 3 has six windows.

Figure 7:
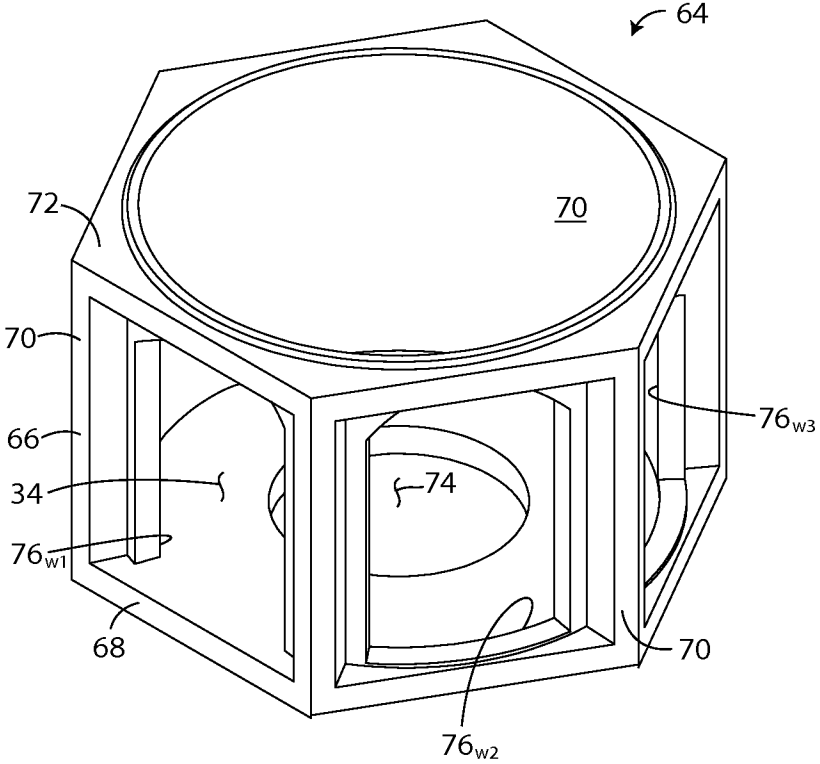
FIG. 7 is a perspective view of one of the cells of the lower level of cells of the stormwater management system of FIG. 1.

An embodiment of an individual cell 64 located within the lower level of cells 40 is shown in FIG. 7. Cell 64 comprises a body portion 66 and a bottom portion 68 that are generally hexagonal in cross-section. The body portion 66 and the bottom portion 68 bound the internal region 34 of cell 64. The body portion 66 includes an interior surface. The interior surface is of a shape that is generally a right circular cylinder. The interior surface at least in part defines the internal region 34. Although the cell 64 of the present embodiment is a module, it is to be understood that the bottom portion 68 and the body portion 66 could be separate pieces that fit together to collectively form cell 64. The body portion 66 comprises six sides 70 and a top edge 72. The body portion 66 is generally in the shape of a hexagonal cylinder. More specifically, the body portion 66 is generally in the shape of an equilateral hexagonal cylinder. The bottom portion 68 of cell 64 is substantially flat and constitutes a floor for the cell. The bottom portion 68 has an opening 74 that is adapted such that stormwater can pass therethrough and flow out of the internal region 34 of cell 64. Moreover, the body portion 66 comprises a plurality of windows 76. In particular, cell 64 has a first window $\mathbf{76}_{W1}$, a second window $\mathbf{76}_{W2}$, and a third window $\mathbf{76}_{W3}$. As shown in FIG. 7, each window 76 is in a different one of the six sides 70. The first window $\mathbf{76}_{W1}$ is spaced from the top edge 72. The second and third windows $\mathbf{76}_{W2}$, $\mathbf{76}_{W3}$ are spaced from the top edge 72 and the bottom portion 68. Each window 76 is adapted to permit passage of stormwater into and out of the internal region 34 of cell 64. Although FIG. 7 shows that each window 76 is of the same arched dimension, it is to be understood that the windows could be of different dimensions. It is to be understood that a cell could have more or fewer windows than that of cell 64. For example, cell 64*a* in FIG. 1 contains four windows.

As can be seen in FIG. 3, a body portion of each of the plurality of cells 32 within the stormwater management system 30 is substantially the same size as the body portion of the other cells within the stormwater management system. It is to be understood, however, that the body portion of at least some of the cells could be of a different size. Moreover, as can be seen in FIGS. 1-3, the plurality of cells 32 within the stormwater management system 30 are arranged in a manner such that the plurality of cells constitute a network having an outer periphery 78. Some of the sides of the plurality of cells 32 located along an outer edge of the stormwater management system 30 constitute the outer periphery 78. The cells 32 of the stormwater management system 30 are preferably arranged such that the outer periphery 78 does not contain any windows. Each side constituting the outer periphery 78 of the stormwater management system 30 preferably comprises a curved wall portion 80. It is to be understood, however, that some or all of the sides that constitute the outer periphery 78 of the stormwater management system 30 could be substantially flat.

As shown in FIGS. 3 and 4, the lower level of cells 40 of the stormwater management system 30 are arranged in a manner so as to form a plurality of parallel walkways 81. Each walkway 81 extends in a single direction from a first side of the stormwater management system to an opposite side of the stormwater management system. Each walkway 81 enables a user to pass from the internal region 34 of one cell within the lower level of cells 40 to the internal region of another cell within the lower level of cells 40 without having to step over a raised surface. A user is able to gain access to the underground system 30 via a plurality of port holes 83 located within the upper level of cells 36.

The stormwater management system 30 is formed by arranging the lower level of cells 40, the intermediate level of cells 38, and the upper level of cells 36 in a generally honeycomb configuration. The intermediate level of cells 38 is arranged between the lower level of cells 40 and the upper level of cells 36. The upper level of cells 36 is arranged such that each one of the top portions 44 is in contact with the top portion 44 of another cell. Some of the upper level of cells 36 are arranged such that the top portions 44 of the cells are in contact with the top portions 44 of at least two other cells.

Figure 8:
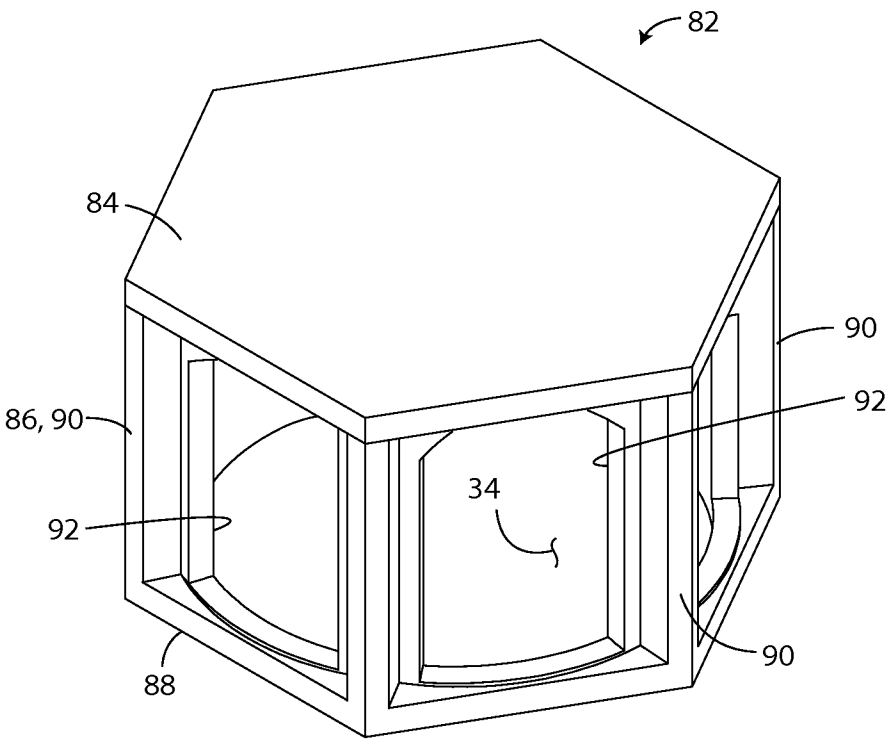
FIG. 8 is a perspective view of another embodiment of a cell of the present invention, the cell of FIG. 8 being similar to the cell of FIG. 5 but having a bottom portion and a flat top.

Another embodiment of an individual cell 82 that could be located within the upper level of cells 36 is shown in FIG. 8. Cell 82 comprises a top portion 84, a body portion 86, and a bottom edge 88. The top portion 84 and the body portion 86 bound the internal region 34 of cell 82. Each of the top portion 84 and the body portion 86 is substantially hexagonal in cross-section. The top portion 84 of cell 82 is substantially flat. It is to be understood, however, that the top portion 84 of the cell 82 can be domed. Each of the body portion 86 and the top portion 84 are separate pieces that fit together to collectively form cell 82. The body portion 86 comprises six sides 90 and a plurality of windows 92. Each window 92 is in a different one of the six sides 90. Each window is adapted to permit passage of stormwater into and out of the internal region 34 of cell 82. Although FIG. 8 shows that each window 92 is of the same arched dimension, it is to be understood that the windows could be of different dimensions. It is also to be understood a cell could have more or fewer windows than that of cell 82.

Figure 9:
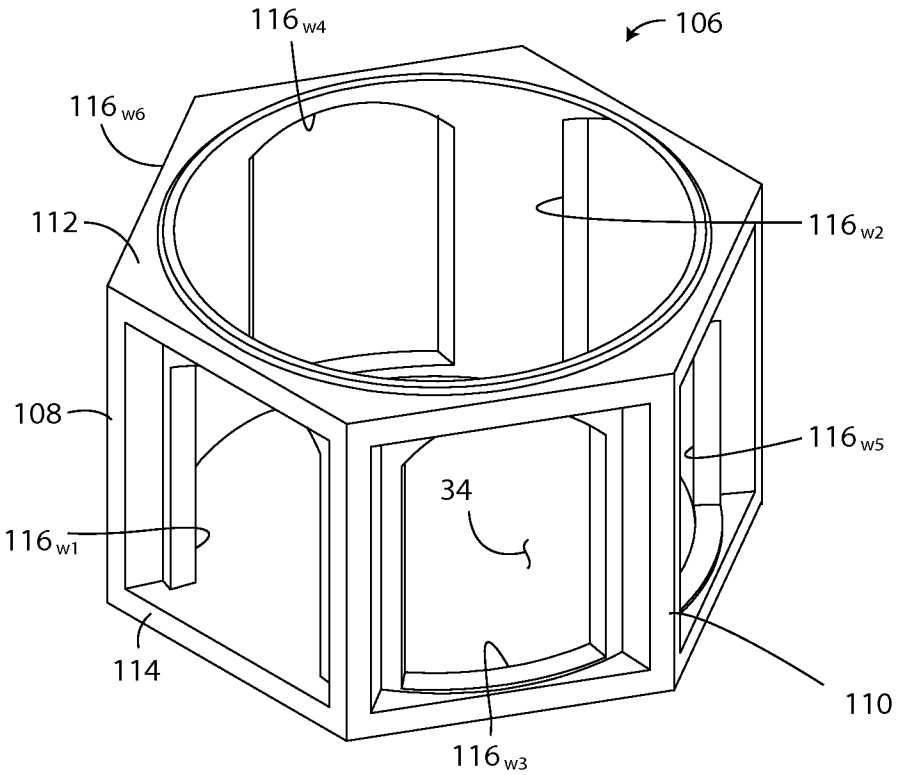
FIG. 9 is a perspective view of another embodiment of a cell of the present invention, the cell of FIG. 9 being similar to the cell of FIG. 7 but having a closed bottom.
Figure 10:
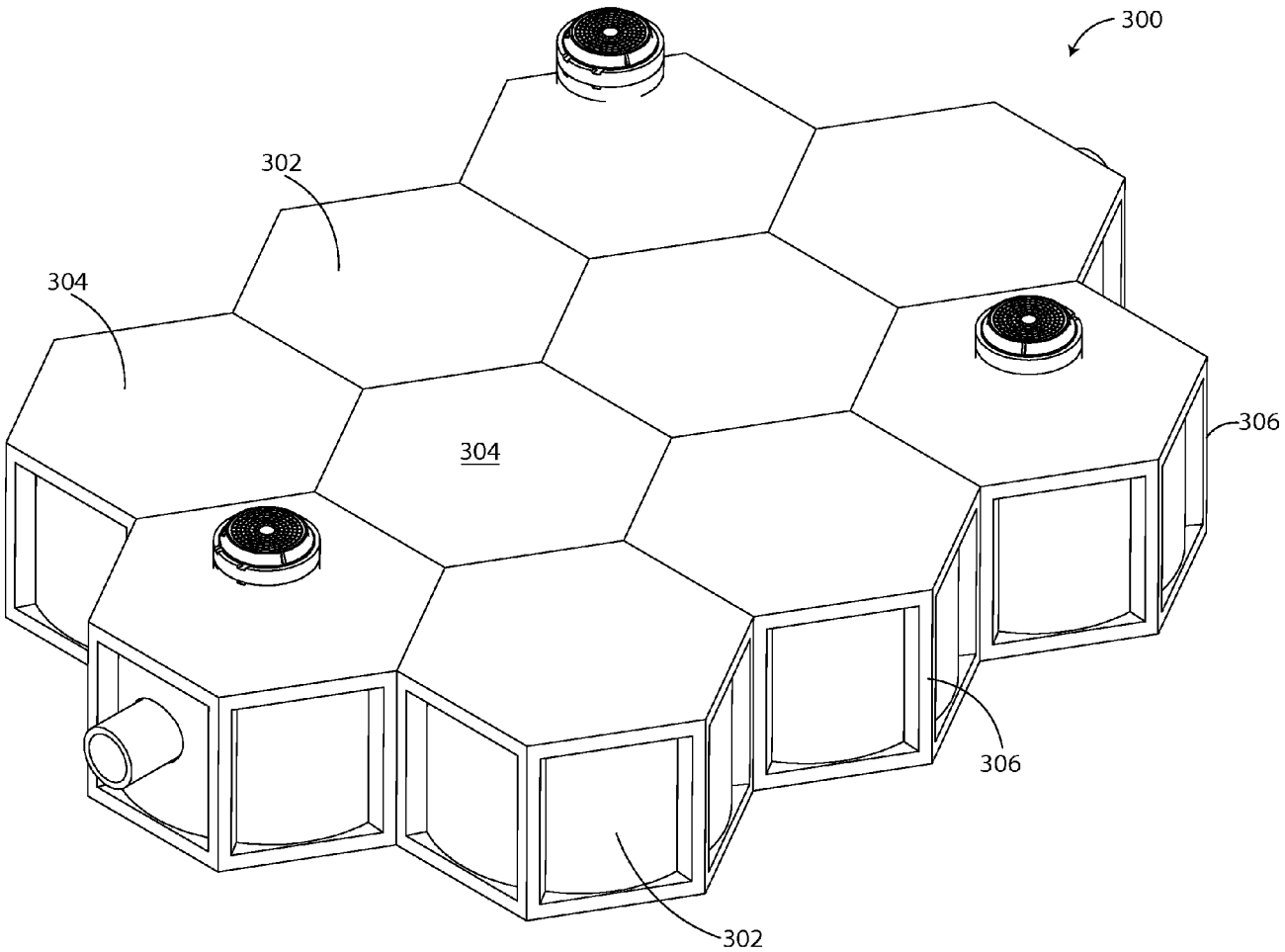
FIG. 10 is a perspective view of another embodiment of a stormwater management system of the present invention.

An alternative embodiment of an individual cell 106 that could be located within the lower level of cells 40 is shown in FIG. 9. Cell 106 comprises a body portion 108 having six sides 110, a top edge 112, and a bottom portion 114. The body portion 108 is generally hexagonal in cross-section and bounds the internal region 34 of cell 106. Although the cell 106 of the present embodiment is a module, it is to be understood that the bottom portion 114 and the body portion 108 could be separate pieces that fit together to collectively form cell 106. The bottom portion 114 constitutes a floor for cell 106. Moreover, the body portion 108 comprises a first window $\mathbf{116}_{W1}$, a second window $\mathbf{116}_{W2}$, a third window $\mathbf{116}_{W3}$, a forth window $\mathbf{116}_{W4}$, a fifth window $\mathbf{116}_{W5}$, and a sixth window $\mathbf{116}_{W6}$. As shown in FIG. 10, each window is in a different one of the six sides 110. The first and second windows $\mathbf{116}_{W1}$, $\mathbf{116}_{W2}$ are opposite each other, the third and fourth windows $\mathbf{116}_{W3}$, $\mathbf{116}_{W4}$ are opposite each other, and the fifth and six windows $\mathbf{116}_{W5}$, $\mathbf{116}_{W6}$ are opposite each other. The first and second windows $\mathbf{116}_{W1}$, $\mathbf{116}_{W2}$ are spaced from the top edge 112 of the body portion 108. The first and second windows $\mathbf{116}_{W1}$, $\mathbf{116}_{W2}$ are not spaced from the bottom portion 114. The third, fourth, fifth, and sixth windows $\mathbf{104}_{W3}$, $\mathbf{104}_{W4}$, $\mathbf{104}_{W5}$, $\mathbf{104}_{W6}$ are spaced from the top edge 112 and bottom portion 114. Although FIG. 10 shows that each window is of the same arched dimension, it is to be understood the windows could be of different dimensions. It is also to be understood that a cell could have more or fewer windows than that of cell 106.

One of ordinary skill in the art will appreciate that the upper level of cells 36 within the stormwater management system 30 could be assembled cells consistent with cell embodiment 42, cells consistent with cell embodiment 82, or cells consistent with cell embodiments 42 and 82. Similarly, one of ordinary skill in the art will appreciate that the lower level of cells 40 could be assembled cells consistent with cell embodiment 64, cells consistent with cell embodiment 106, or cells consistent with cell embodiments of 64 and 106.

One of ordinary skill in the art will also appreciate that the stormwater management system 30 can be formed such that the intermediate level of cells 38 is omitted. Alternatively, one of ordinary skill in the art will appreciate that the stormwater management system 30 can be formed such that the stormwater management system includes more than one intermediate level of cells.

Figure 11:
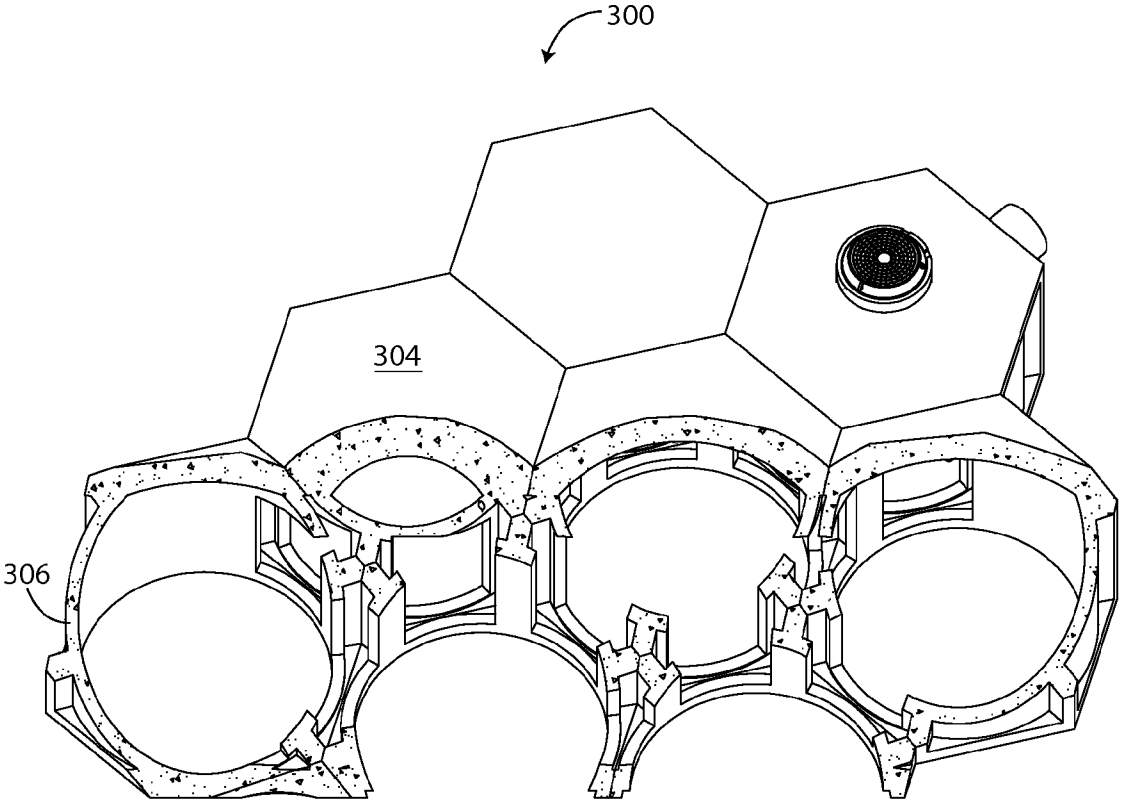
FIG. 11 is a perspective view of the stormwater management system of FIG. 10 with portions broken away to show detail.

Another embodiment of a stormwater management system of the present invention is shown in FIGS. 11-12 and indicated generally by reference numeral 300. The underground system 300 is similar to the stormwater management system 30, except that it comprises only a single level of cells 302 wherein each cell is generally level with each other cell. Although FIGS. 11-12 depicts each of the plurality of cells 302 within the stormwater management system 300 as having a substantially flat top portion 304, one of ordinary skill in the art will understand that the top portion of each of the plurality of cells could be domed. Moreover, as shown in FIG. 12, each of the plurality of cells 302 comprises only a top portion 304 and a body portion 306. Notably, each of the plurality of cells does not comprise a bottom portion. One of ordinary skill in the art, however, will understand that all or some of the plurality of cells 302 could comprise a bottom portion. One of ordinary skill in the art will also understand that if all or some the plurality of cells 302 contain a bottom portion, the bottom portion may have an opening to enable stormwater to pass therethrough.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, the order in which the steps of any method claim that follows are presented should not be construed in a manner limiting the order in which such steps must be performed.

What is claimed is:

1. A stormwater management system, the system comprising a plurality of cells arranged in a generally honeycomb configuration, each of the plurality of cells being generally hexagonal in cross-section and having an internal region, the plurality of cells being in fluid communication with one another to allow stormwater to flow from the internal region of one of the plurality of cells to the internal region of another of the plurality of cells, wherein each of the plurality of cells is generally level with each of the other cells of the plurality of cells, wherein each of the plurality of cells comprises a hexagonal body portion comprising six sides and a window in one of the sides, the window of each cell being adapted to permit passage of stormwater into and out of the internal region of such cell, the window of each of the plurality of cells being adjacent a window of another of the plurality of cells, wherein the plurality of cells constitute a network having an outer periphery, a combination of some of the sides of some of the plurality of cells constituting the outer periphery of the network, wherein the outer periphery of the network comprises a plurality of curved wall portions.

2. A cell for a stormwater management system adapted for retaining or detaining stormwater, the cell comprising a body portion and an internal region, the body portion being generally hexagonal in cross-section, the body portion comprising six sides and a window in one of the sides, the window being adapted to permit passage of stormwater into and out of the internal region, wherein the body portion is generally in the shape of an equilateral hexagonal cylinder, wherein the body portion includes an interior surface, the interior surface at least in part defining the internal region, the interior surface being of a shape that is generally a circular cylinder.

3. A cell as set forth in claim 2 wherein the body portion is a molded, one-piece construction.

4. A cell as set forth in claim 2 wherein the cell comprises a top portion.

5. A cell as set forth in claim 4 wherein the top portion is generally hexagonal in cross-section.

6. A cell as set forth in claim 4 wherein the top portion is domed.

7. A cell as set forth in claim 4 wherein the top portion and the body portion collectively constitute a module.

8. A cell as set forth in claim 7 wherein the module is of concrete.

9. A cell as set forth in claim 2 wherein the window in one of the sides constitutes a first window in a first side, and the cell further comprises a second window in a second side.

10. A cell as set forth in claim 2 wherein the cell comprises a bottom portion constituting a floor.

11. A cell as set forth in claim 10 wherein the floor comprises an opening, the opening being adapted such that stormwater can flow out of the internal region of the cell via the opening.

* * * * *